US007861856B2

(12) United States Patent
Rowe

(10) Patent No.: US 7,861,856 B2
(45) Date of Patent: Jan. 4, 2011

(54) DISPOSABLE TISSUE PACKAGE WITH REFLECTIVE SURFACE AND REFLECTIVE ELEMENT FOR USE WITH TISSUE PACKAGES

(75) Inventor: Rick Rowe, Las Vegas, NV (US)

(73) Assignee: Think Tek, Inc., Las Vegas, NV (US)

( * ) Notice: Subject to any disclaimer, the term of this patent is extended or adjusted under 35 U.S.C. 154(b) by 499 days.

(21) Appl. No.: 11/712,185

(22) Filed: Feb. 27, 2007

(65) Prior Publication Data

US 2008/0202952 A1 Aug. 28, 2008

(51) Int. Cl.
*B65D 71/00* (2006.01)

(52) U.S. Cl. ..... 206/233; 206/581; 206/494; 206/812

(58) Field of Classification Search ..... 206/233, 206/494, 810, 812, 37, 216, 581, 38, 210, 206/235, 823; 132/301, 304, 316; 359/883; 220/212, 694
See application file for complete search history.

(56) References Cited

U.S. PATENT DOCUMENTS 4,250,938 A * 2/1981 Siegel ..... 150/111
4,863,064 A * 9/1989 Dailey, III ..... 221/48
4,951,811 A * 8/1990 Lines ..... 206/5
5,173,804 A * 12/1992 Dogey ..... 359/507
5,247,395 A * 9/1993 Martinez ..... 359/883
5,476,194 A * 12/1995 Hippely et al. ..... 222/192
5,524,759 A * 6/1996 Herzberg et al. ..... 206/494
5,915,545 A * 6/1999 Shackel et al. ..... 206/5.1
6,065,843 A * 5/2000 Martinez, Sr. ..... 359/847
6,113,271 A * 9/2000 Scott et al. ..... 383/211
6,383,504 B1 * 5/2002 Dotson ..... 424/402
6,789,664 B1 * 9/2004 Chao ..... 206/5
6,978,889 B2 * 12/2005 McBride ..... 206/210
7,594,373 B2 * 9/2009 Abergel ..... 53/467
2005/0067421 A1 * 3/2005 Maldonado et al. ..... 221/33
2006/0054517 A1 * 3/2006 Albert ..... 206/233

* cited by examiner

*Primary Examiner*—David T Fidei
(74) *Attorney, Agent, or Firm*—Weide & Miller, Ltd.

(57) ABSTRACT

A portable or disposable package of tissues includes a reflective surface. The surface may be directly associated with the package. In another embodiment, the reflective surface is associated with another body which is connected to the package. That body may be removable from the package, so that it may be used with successive packages after the tissues in prior packages have been exhausted and the package disposed of.

7 Claims, 4 Drawing Sheets

DISPOSABLE TISSUE PACKAGE WITH REFLECTIVE SURFACE AND REFLECTIVE ELEMENT FOR USE WITH TISSUE PACKAGES

FIELD OF THE INVENTION

The present invention relates to tissue packages.

BACKGROUND OF THE INVENTION

Tissues, such as marketed under the brand name KLEENEX®, are marketed in a variety of packages. Commonly, the tissues are located in rigid cardboard containers. These containers may have a variety of shapes and sizes and include exterior ornamentation. In general, however, the containers are quite large, often 4-8 inches wide, tall and/or long, as they are configured to store a large supply of tissues.

Because these containers are large and rigid, they are not readily suitable for transport or for use in locations in which space is a substantial concern. As such, tissues marketed in these packages or containers are typically used in the home, office or similar location.

There is a need, however, for tissues in a wide variety of other environments, such as while traveling, in the car and the like. As such, tissues are also packaged in smaller, portable or "travel" type packages. Typically, these packages contain a smaller number of tissues, such as 5-10 tissues. In cases where the package or container is constructed of cardboard or a similar generally rigid material, the container is generally constructed to be much smaller in size. More frequently, however, the tissues are located in a pliable or flexible plastic bag type package. The package essentially comprises plastic sheet material configured into a generally closed container or bag. These containers or packages are very lightweight and because they are flexible, may be fit into spaces of very small sizes.

Tissues are generally used to for "cleaning" purposes, such as to blow one's nose, wipe tears, clean off make-up and the like. As such, a person who utilizes a tissue frequently wishes to view the area to which the tissue was applied in order to ensure that the area was properly cleaned, to ensure that no tissue remnants are left and the like. This is a simple task in a home bathroom or the like where a mirror is present in relative close proximity to tissues. However, this is problematic when the person is traveling, outdoors or the like and using tissues from a portable package.

SUMMARY OF THE INVENTION

One aspect of the invention is a disposable or portable tissue package including a reflective surface. Another aspect of the invention is a reflective element which may be associated with a tissue package.

In one embodiment, a portable or disposable tissue package comprises a pliable plastic package generally defining an interior space and having an exterior surface, a plurality of tissues located in the interior space of the package, the package including at least one reflective surface.

The reflective surface may be defined by a material which is applied or otherwise associated with the tissue package.

One embodiment of the invention is a reflective element which may be associated with a package, such as a tissue package. The element comprises a body having at least one reflective surface. The body may include means for connecting it to a package. This means may comprise adhesive.

In a method of use, a tissue may be removed from the package and then the reflective surface of the package may be utilized. In the event the reflective surface is associated with a removable body, that reflective surface may be moved from package to package.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a tissue package having a reflective element. Preferably, the tissue package is a disposable or travel type package. Another embodiment of the invention is a reflective element which may be associated with a tissue package.

Figure 1:
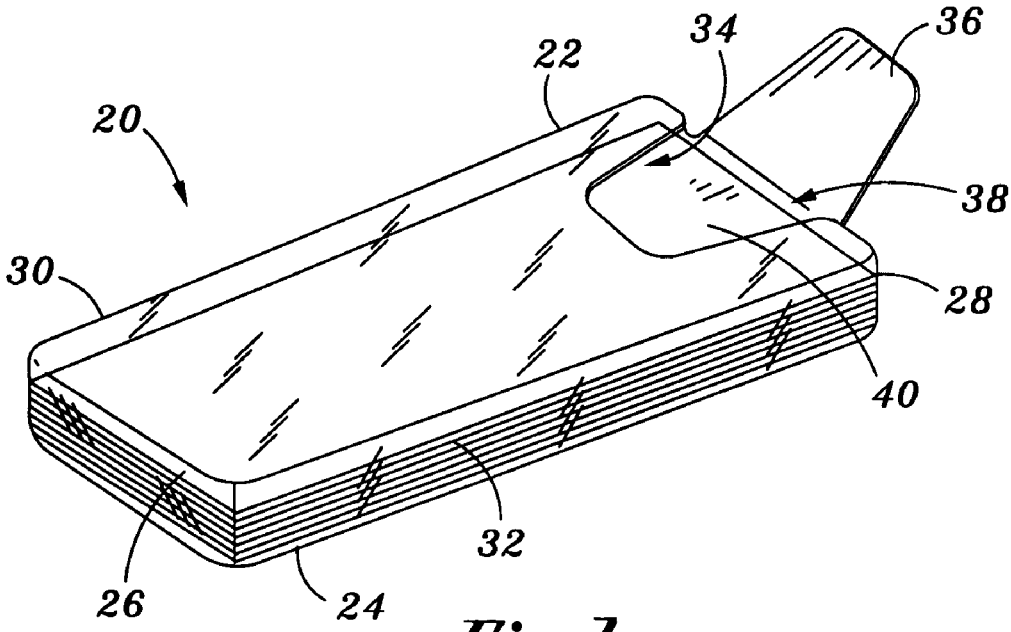
Fig. 1 (PRIOR ART)
FIG. 1 is a perspective view of an embodiment of a portable or disposable tissue package in accordance with the prior art.

One embodiment of the invention will be described with reference to FIGS. 1 and 2. FIG. 1 illustrates a tissue package in accordance with the prior art. This tissue package 20 comprises a generally flexible plastic material formed into an enclosure. As illustrated, the enclosure is generally rectangular, having a top 22, a bottom 24, a first end 26, a second end 28, a first side 30 and a second side 32. The package 20 generally defines an interior space 34. The package 20 also has an exterior surface associated with each portion thereof, such as an exterior top surface, exterior bottom surface and the like.

In one embodiment, a portion of the package may be opened to provide access to the interior space 34. As illustrated, a flap 36 may be at least partially separated from the remainder of the package 20. The flap 36 may be located at one end 28 of the package. When opened, the flap 36 defines an opening 38 leading to the interior space 34. The size and shape of the flap 36 may vary, such as dependent upon the size of the package and the size of the tissues to be removed. In other embodiments, access to the interior space 34 may be provided in other manners, such as by opening an end portion of the package, by cutting or tearing a portion of the material, or even by completely removing a portion of the material from the remainder of the package.

One or more tissues 40 are located in the package. As illustrated, the tissues 40 may be folded into a configuration in which they match the cross-sectional shape of the package.

The material forming the package 20 may be generally transparent or clear. In this manner, the tissues 40 are visible through the package. This permits, for example, the user to determine the number of tissues remaining the package.

Figure 2:
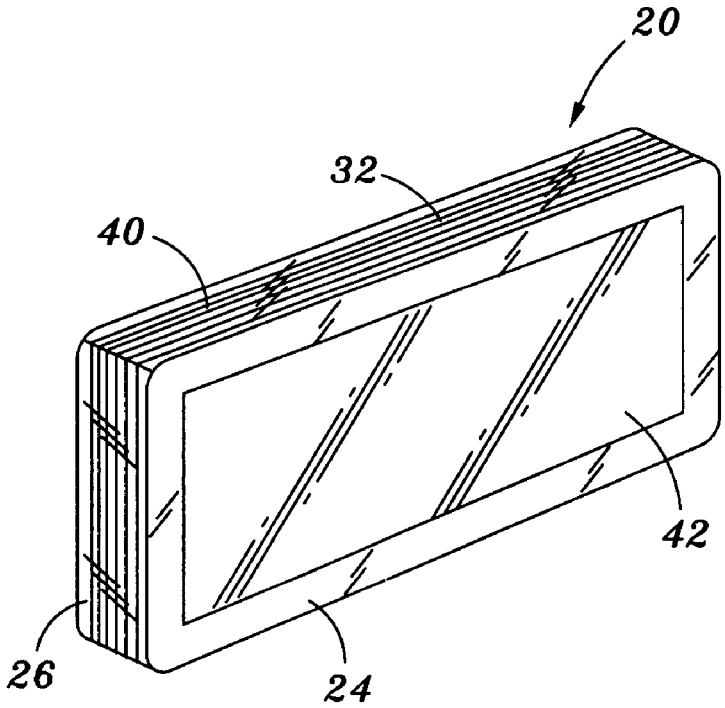
FIG. 2 is a rear perspective view of an embodiment of a portable or disposable tissue package having a reflective surface in accordance with the present invention.

Referring to FIG. 2, in accordance with one embodiment of the invention, the package 20 includes at least one reflective surface 42. In one embodiment, the reflective surface 42 comprises a reflective material which is associated with the package 20. For example, a metallic or other reflective material may be deposited on or into, adhered to, connected to, embedded in or otherwise associated with the package 20. In one embodiment, as described in greater detail below, the reflective surface may be associated with another body or element which is itself associated with the package.

In one embodiment, as illustrated in FIG. 2, the reflective surface 42 is located at the bottom 24 of the package. The reflective surface may be located at various areas or portions or the package 20, such as the top, sides or the like (or combinations thereof). Preferably, the reflective surface 42 faces outwardly of the package 20. In one embodiment, the reflective surface 42 comprises a substantial portion of the surface area of the package 20, such as a substantial portion of the bottom 24 of the package 20, whereby the reflective surface 42 is sufficiently large to be utilized as a mirror.

In one embodiment, the reflective surface 42 is located at the exterior of the package 20. In another embodiment, the reflective surface 42 is simply visible from the exterior of the package 20. For example, if the package 20 is constructed from a transparent material, the reflective surface 42 might be located in or behind (i.e. at the interior of the package) that surface and thus still be visible to the user.

Figure 3:
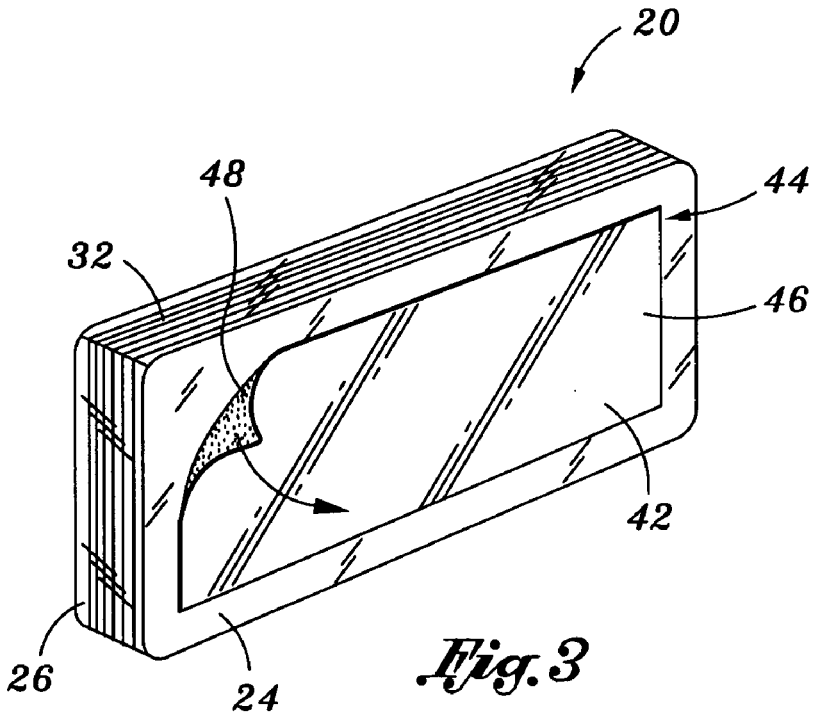
FIGS. 3 and 4 illustrate a portable or disposable tissue and a removable reflective member in accordance with an embodiment of the present invention.
Figure 4:
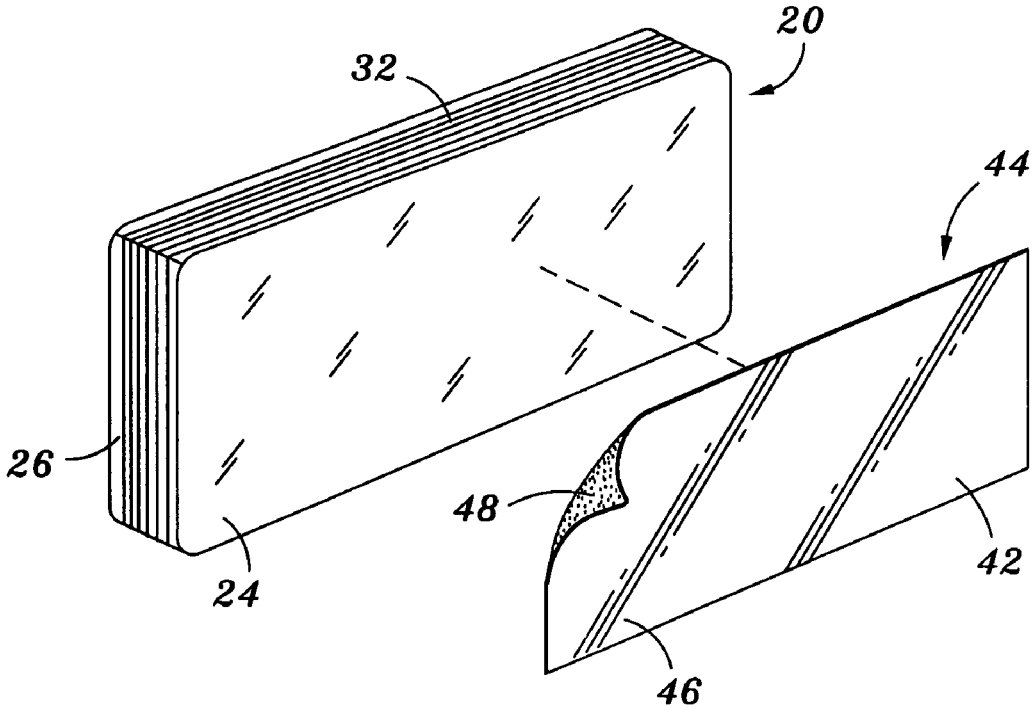

Another embodiment of the invention is illustrated in FIGS. 3 and 4. As illustrated therein, the reflective surface 42 is defined on or by a body 44 or member which is connected to the package 20. In a preferred embodiment, that body 44 is selectively connectable to the package 20. In one embodiment, the body 44 has a first side 46 and a second side 48. At least one of the sides defines the reflective surface 42. The other side is configured to be located adjacent the package 20.

As one example, the body 44 might comprise a sheet of Mylar® (a brand of DuPont) or other polyethylene terephthalate (PTE) or similar plastic film material having at least one reflective side, such as a side having a metallic or metal surface, as described below and is one configuration for such films. The body 44 might also comprise a substrate or base material which is non-reflective and which has a reflective material applied thereto on at least one side.

In one embodiment, means are provided for selectively connecting the body 44 to the package 20. This means might comprise adhesive, one or more fasteners or the like. For example, an adhesive may be applied to the second side 48 of the body 44 for adhering the body 44 to the package 20.

A covering may be applied over the adhesive side of the body 44 before it is used. This covering may be peeled away to expose the adhesive the first time the body 44 is to be associated with a package 20.

In one embodiment, referring to FIGS. 3 and 4, the body 44 may be connected to a package 20 which does not otherwise include a reflective surface, thereby providing the package with a reflective surface. In addition, the body 44 may be removed from the package 20. For example, the body 44 might be removed from an empty package 20 before that package is thrown away. This may permit the body 44 to be associated with a different package. For example, the body 44 may then be associated with a new, full package 20.

In a preferred embodiment, the reflective surface (and a body with which it is associated, in such an embodiment) is pliable, permitting it to conform to changes in the shape of the package. For example, it is preferred that the reflective surface not prevent a flexible plastic or similar package such as that illustrated in FIG. 1 from being folded or otherwise compressed into a different shape, as might occur if the package were being forced into a differently sized space (like a pocket or the like). In other embodiments, the reflective surface or member might be generally rigid, such as a reflective material applied to a plastic substrate.

Figure 5A:
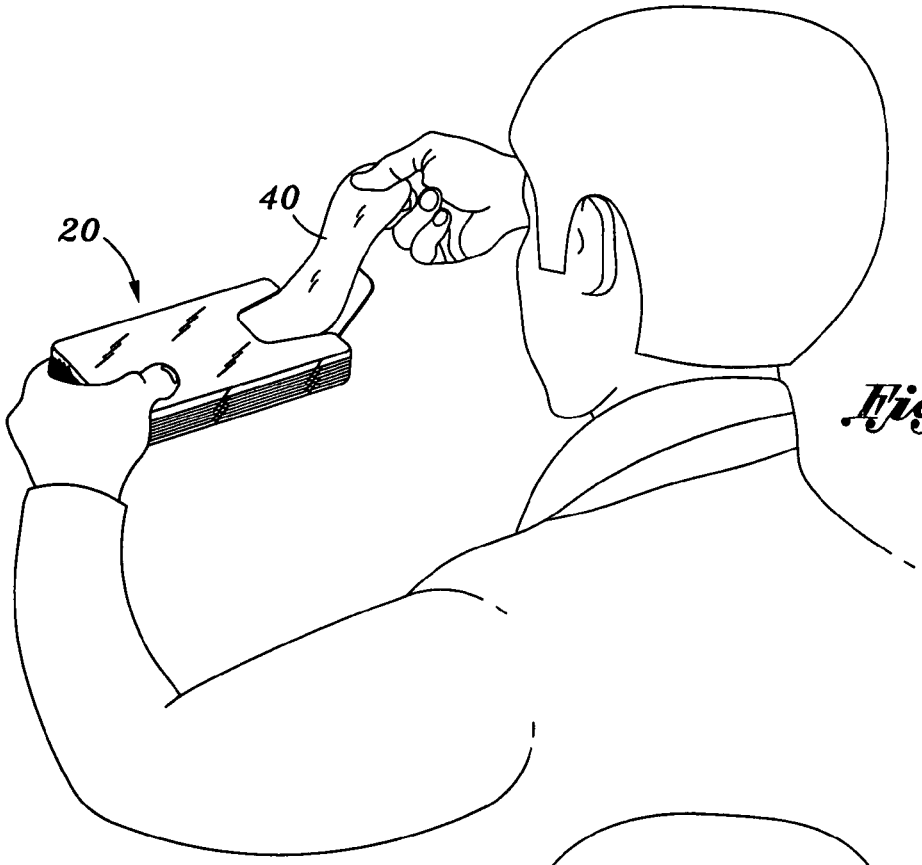
FIGS. 5A and 5B illustrate use of a portable or disposable tissue package having a reflective surface, in accordance with an embodiment of the invention.
Figure 5B:
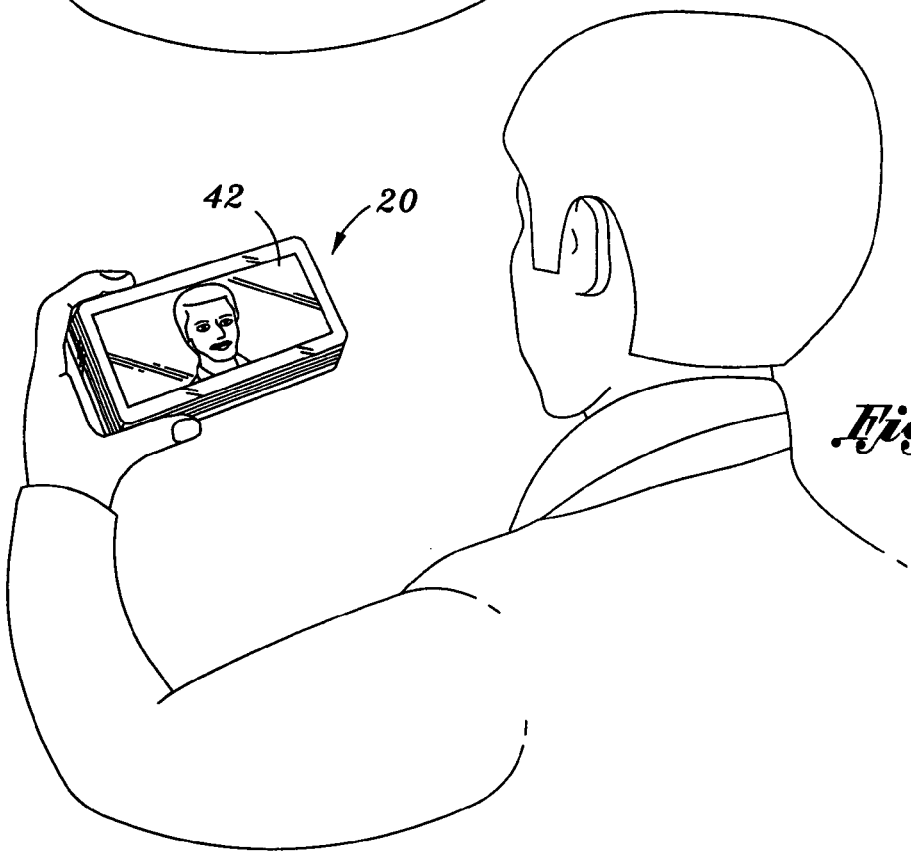

Various aspects of the invention will now be appreciated. First, in accordance with the invention, a reflective surface is associated with a portable or disposable tissue package. In this manner, when the user uses a tissue, a reflective surface is conveniently provided for use by the user. For example, referring to FIG. 5A, a user may remove a tissue 40 from the package 20 and then use that tissue. As illustrated in FIG. 5B, the user may then turn the package over so that the reflective surface 42 faces them, so that they may see their face or another portion of their body.

In one embodiment, the reflective surface may be integral to the package. In this configuration, the reflective surface may be manufactured as an element of the package and be disposed with the package.

Figure 6:
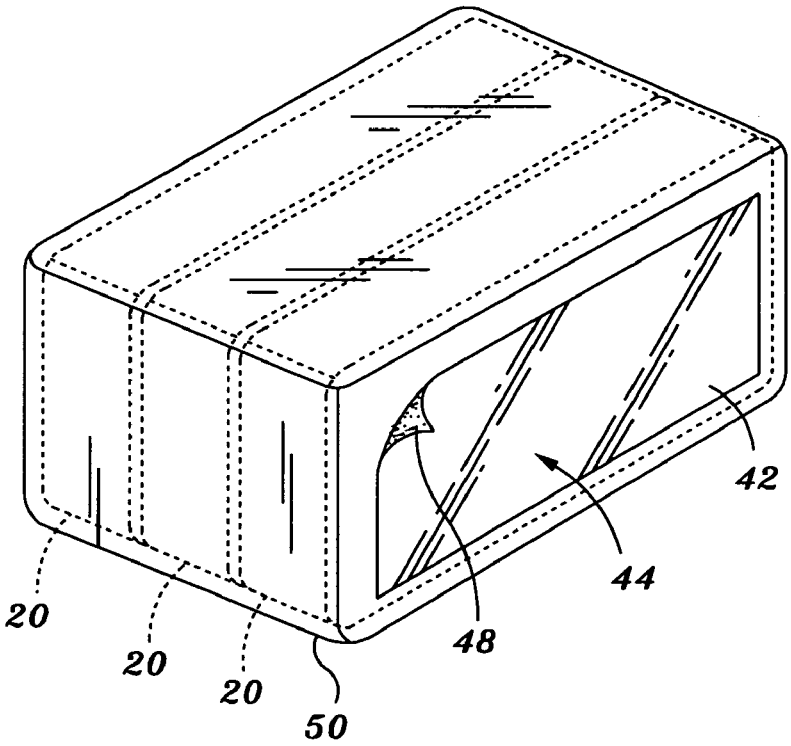
FIG. 6 illustrates a package of multiple tissue packages having an associated reflective member.

Another embodiment of the invention is a portable or removable reflective surface that may be associated with one or more packages. In this configuration, a user may obtain a reflective surface and associate it with a package. The user may also remove the reflective surface from one package and associate it with another package. For example, as illustrated in FIG. 6, a consumer may purchase bulk package 50 of 4 or 6 packages 20 of tissues. A portable reflective 44 surface may be associated with the bulk package 50 or one of the individual packages 20 and may be selectively connected to each of the individual packages as they are utilized.

In a preferred embodiment, the package with which the reflective element is associated is a pliable, plastic package. In other embodiments, however, the package might be of a variety of other configurations. For example, the tissue package might be constructed of paperboard or the like, and yet still be small in size so as to be portable/disposable.

The reflective surface may be used for a variety of purposes. For example, in the event of an emergency, the reflective surface might be used as a signaling device. In the case where the reflective surface is associated with a body which can be removed from the package, the body may be removed from the package and placed on another surface, such as the top of a car.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. Tissues with a mirror feature comprising:

a plurality of tissue packages packaged together, each tissue package comprising:

a pliable plastic package generally defining an interior space and having an exterior surface; and a plurality of tissues located in said interior space of said package; and a reflective member packaged with said tissue packages, said reflective member having a first side defining a reflective surface which may be used as a mirror and a second side having one or more adhesive areas and including at least one cover sheet removable from said one or more adhesive areas to expose said adhesive areas, permitting said reflective member to be connected to said exterior of each of said tissue packages and then be removed there from as each of said tissue packages are utilized.

2. The tissues with a mirror feature in accordance with claim 1 wherein said reflective member comprises a film having a reflective surface.

3. The tissues with a mirror feature in accordance with claim 1 wherein said first side of said reflective member comprises a metallic material.

4. The tissues with a mirror feature in accordance with claim 2 wherein said film is flexible.

5. The tissues with a mirror feature in accordance with claim 1 wherein said plurality of tissue packages comprises 4 to 6 tissue packages.

6. The tissues with a mirror feature in accordance with claim 1 wherein said tissue packages have at least one generally planar exterior surface and said reflective member has a size generally the same as said exterior surface.

7. The tissues with a mirror feature in accordance with claim 1 wherein said reflective member comprises a polyethylene terephthalate film having at least one metallic side.

* * * * *